US009998830B2

(12) United States Patent
Mao et al.

(10) Patent No.: US 9,998,830 B2
(45) Date of Patent: Jun. 12, 2018

(54) SPEAKER

(71) Applicants: Lubin Mao, Shenzhen (CH); Shun Guo, Shenzhen (CN); Chengxia Ji, Shenzhen (CN)

(72) Inventors: Lubin Mao, Shenzhen (CH); Shun Guo, Shenzhen (CN); Chengxia Ji, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days. days.

(21) Appl. No.: 15/416,692

(22) Filed: Jan. 26, 2017

(65) Prior Publication Data

US 2017/0347197 A1 Nov. 30, 2017

(30) Foreign Application Priority Data

May 26, 2016 (CN) ..... 2016 2 0499363 U

(51) Int. Cl.

| | |
|---|---|
| ***H04R 1/00*** | (2006.01) |
| ***H04R 9/02*** | (2006.01) |
| ***H04R 9/06*** | (2006.01) |
| ***H04R 7/18*** | (2006.01) |

(52) U.S. Cl.

CPC ..... *H04R 9/025* (2013.01); *H04R 7/18* (2013.01); *H04R 9/06* (2013.01)

(58) Field of Classification Search

USPC ..... 381/398

See application file for complete search history.

(56) References Cited

U.S. PATENT DOCUMENTS 5,590,210 A * 12/1996 Matsuo ..... H04R 9/025 29/594

2008/0137901 A1* 6/2008 Michno ..... H04R 9/00 381/407

* cited by examiner

*Primary Examiner* — Sunita Joshi

(74) *Attorney, Agent, or Firm* — Na Xu; IPro, PLLC

(57) ABSTRACT

A speaker is provided in the present disclosure. The speaker includes a shell, vibration system which received in the shell and a magnetic circuit system which disposed below the vibration system and used for driving the vibration system to vibrate for producing sound, the magnetic circuit system including a main magnet assembly and a fixing assembly, the main magnet assembly includes a first main magnet, a second main magnet homopolarly opposite to the first main magnet and spaced from the first main magnet, a magnetizer sandwiched between the first main magnet and the second main magnet, and positioning holes penetrating the first main magnet, the magnetizer and the second main magnet, the fixing assembly comprises fasteners penetrating through the positioning holes and a pressure plate matched with the fasteners to fix the main magnet assembly.

10 Claims, 3 Drawing Sheets

SPEAKER

FIELD OF THE DISCLOSURE

The present disclosure generally relates to sound production device, and more particularly, to a speaker.

BACKGROUND

In audio equipment, the speaker is a common electronic component and is mainly used for playing audio signals, so its structural design directly influences the audio playing quality. The speaker in relevant technologies generally includes a magnetic circuit system, a vibration system and a shell, wherein the magnetic circuit system includes a pair of homopolarly opposite magnets and a soft magnet sandwiched between the magnets, and the two magnets are assembled with the soft magnet by gluing.

However, in the magnetic circuit system of the relevant technologies, the two magnets are homopolarly opposite magnets between which there is repulsive force, and are assembled only by gluing, so that the fixation effect is poor, the reliability of the magnetic circuit system is greatly influenced, and the acoustic performance of the speaker is thus influenced.

Therefore, it is desired to provide a speaker to overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and embodiments thereof.

Figure 1:
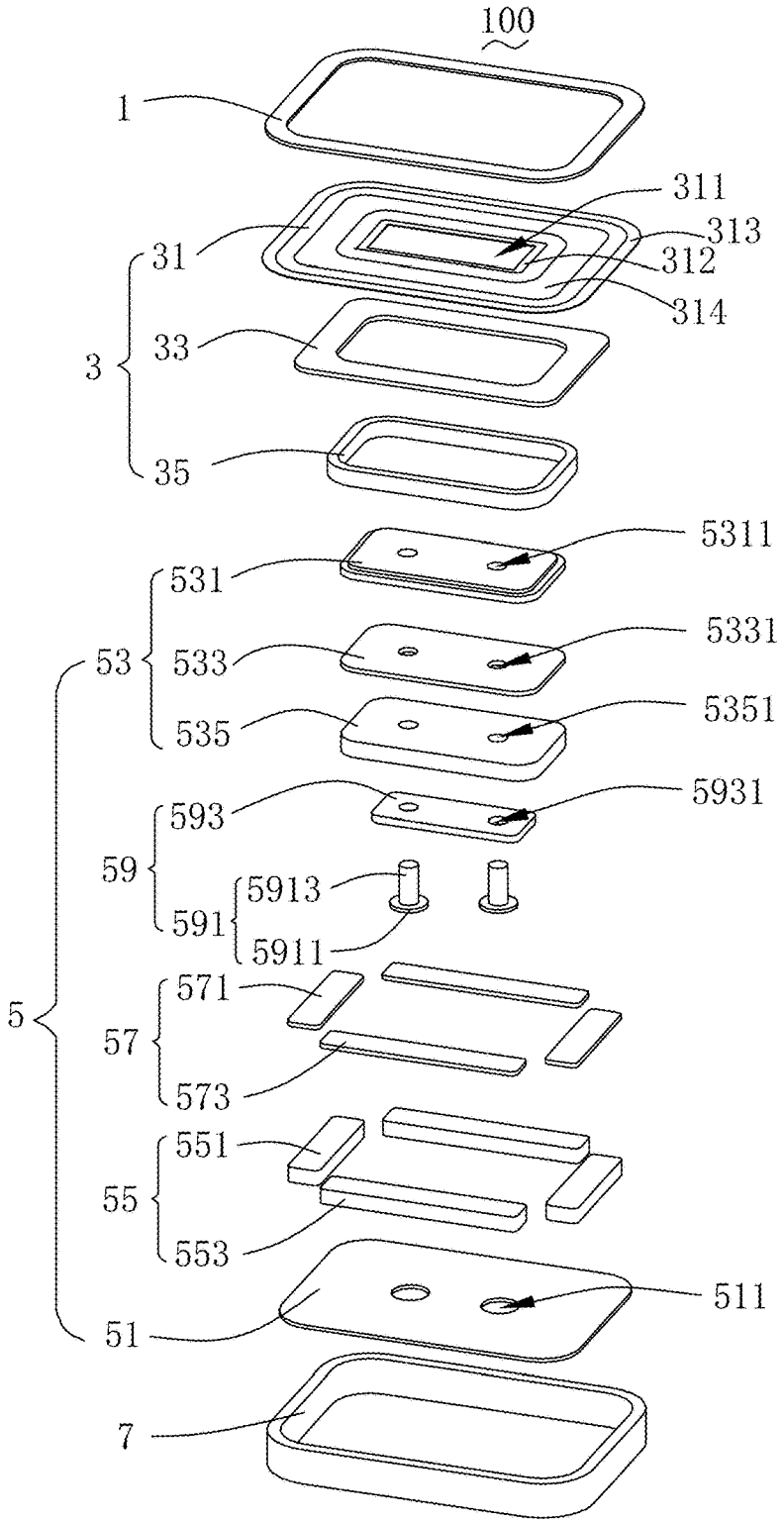
FIG. 1 is a three-dimensional exploded schematic diagram of a preferred embodiment of a speaker provided by the present disclosure.
Figure 2:
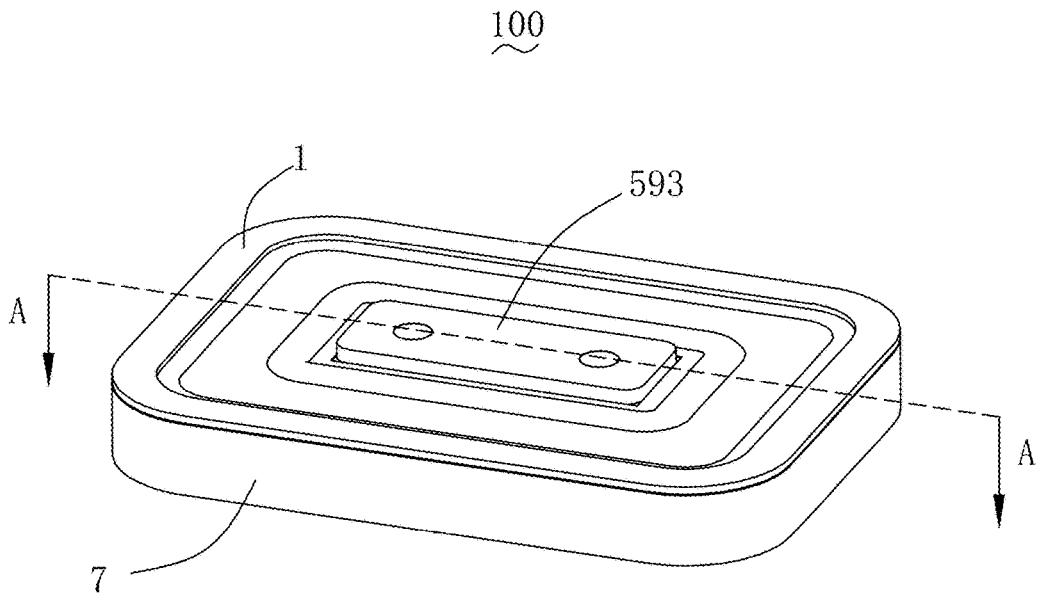
FIG. 2 is a three-dimensional assembly schematic diagram of the speaker shown in FIG. 1.
Figure 3:
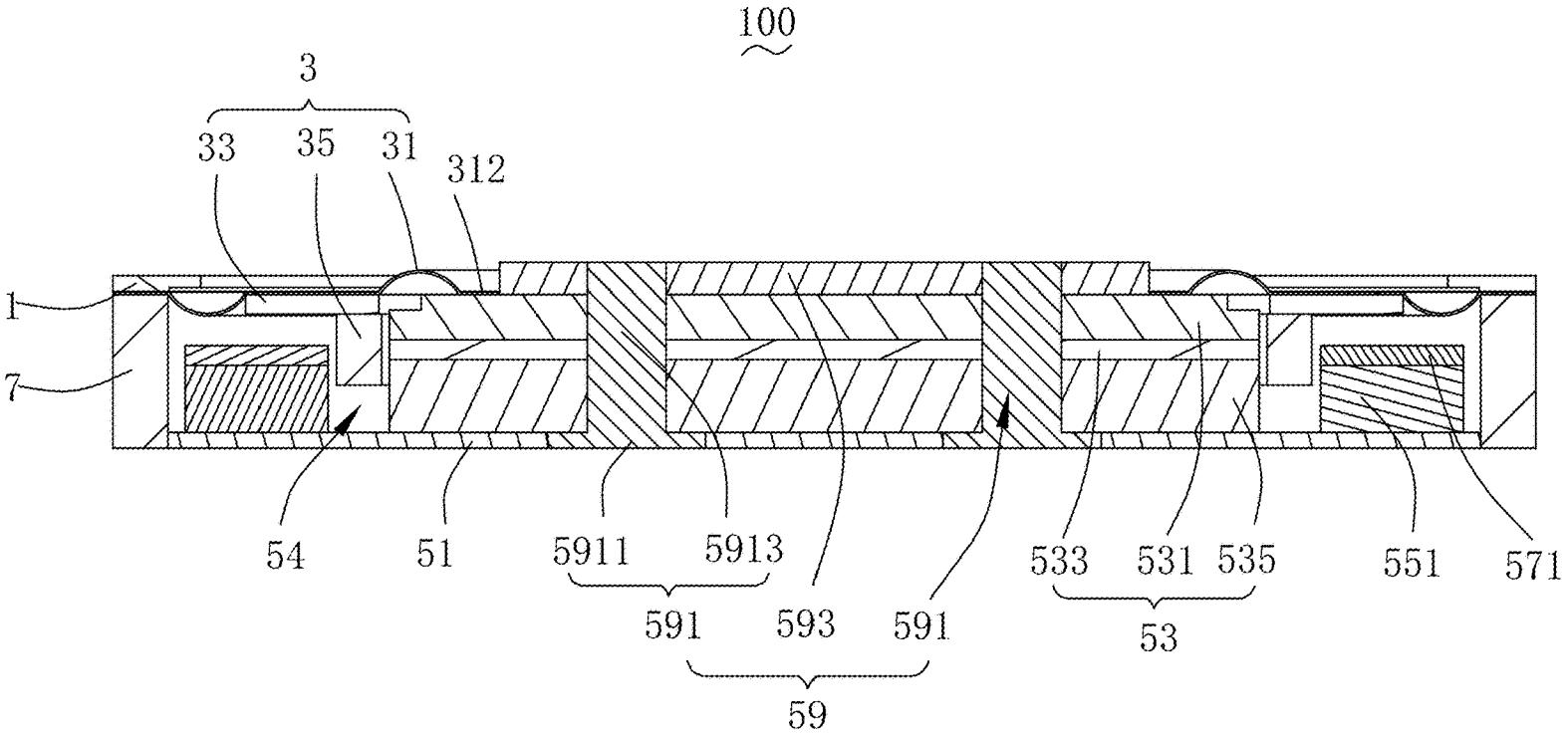
FIG. 3 is a cross-sectional view of the speaker shown in FIG. 2 along the A-A line.

Referring to FIGS. 1-3, a speaker 100 includes a shell having a receiving space assembled by a cover plate 1 and a frame 7, as well as a vibration system 3 and a magnetic circuit system 5 received in the receiving space. The magnetic circuit system 5 is used for generating a magnetic field, and the vibration system 3 is driven in the magnetic field to vibrate so as to produce sound. In this embodiment, both the cover plate 1 and the frame 7 are in an annular rectangle shape.

The vibration system 3 includes a diaphragm 31, a dome 33 and a voice coil 35 for driving the diaphragm 31 to vibrate for producing sound, which are stacked in sequence from top to bottom. An accommodating hole 311 is formed in the center of the diaphragm 31, and the diaphragm 31 includes an inner circumference 312 surrounding the accommodating hole 311, an outer circumference 313 sandwiched between the cover plate 1 and the frame 7 and a vibration part 314 connecting the inner circumference 312 with the outer circumference 313.

The magnetic circuit system 5 includes a yoke 51, a main magnet assembly 53, a vice magnet assembly 55, a pole plate assembly 57 and a fixing assembly 59. Both the main magnet assembly 53 and the vice magnet assembly 55 are assembled on the yoke 51, the vice magnet assembly 55 surrounds the main magnet assembly 53, a magnetic gap 54 is formed between the main magnet assembly 53 and the vice magnet assembly 55, the voice coil is inserted into the magnetic gap 54, the pole plate assembly 57 is attached to the surface of the vice magnet assembly 55 away from the yoke 51, and the fixing assembly 59 is disposed on the yoke 51 and used for fixing the main magnet assembly 53.

In this embodiment, the yoke 51 is of a flat-plate structure, and is matched with the cover plate 1 and the frame 7 to form the receiving space for receiving the vibration system 3 and the magnetic circuit system 5.

The main magnet assembly 53 is disposed in the middle of the yoke 51, and includes a first main magnet 531, a magnetizer 533 and a second main magnet 535 stacked in sequence from top to bottom, that is, the second main magnet 535 is attached to the yoke 51, and the first main magnet 531 is homopolarly opposite to the second main magnet 535.

The first main magnet 531 and the second main magnet 535 are permanent magnets, respectively having an N pole and an S pole at two ends in the vertical direction. Specifically, the N pole of the first main magnet 531 presses against the magnetizer 533, and the N pole of the second main magnet 535 presses against the magnetizer 533, that is, the N pole of the first main magnet 531 is disposed opposite to the N pole of the second main magnet 535, so that the first main magnet 531 and the second main magnet 535 are homopolarly opposite.

In this embodiment, the first main magnet 531 is connected with the magnetizer 533 by gluing, and the second main magnet 535 is connected with the magnetizer 533 by gluing, thereby further guaranteeing that the main magnet assembly 53 is fixed firmly. In other embodiments, the first main magnet 531 is connected with the magnetizer 533 in other mode without gluing, and the second main magnet 535 is connected with the magnetizer 533 in other mode without gluing.

The vice magnet assembly 55 includes a pair of first vice magnets 551 and a pair of second vice magnets 553, the two first vice magnets 551 are symmetrically disposed on two opposite sides of the main magnet assembly 53, and the two second vice magnets 553 are symmetrically disposed on the other two opposite sides of the main magnet assembly 53.

The pole plate assembly 57 is made of a magnetic material, achieves an effect of magnetic conduction, and includes a pair of first vice pole plates 571 and a pair of second vice pole plates 573 correspondingly attached to the two first vice magnets 551 and the two second vice magnets 553. The first vice pole plates 571 and the second vice pole plates 573 are respectively consistent with the corresponding first vice magnets 551 and second vice magnets 553 in shape and size.

The fixing assembly 59 includes fasteners 591 and a pressure plate 593 matched with the fasteners 591 to fix the main magnet assembly 53. There may be a plurality of fasteners 591, in this embodiment, there are two fasteners 591, and the two fasteners 591 are disposed symmetrically at interval.

The fastener 591 includes a base 5911 disposed on the yoke 51 and a cylinder 5913 extended from the base 5911 to a direction departing from the yoke 51.

At the positions corresponding to the bases 5911, the yoke 51 is provided with yielding gaps 511 for accommodating the bases 5911 to reduce spatial loss and simultaneously realize firm fixation, so that the fasteners 591 are unlikely to shift.

The main magnet assembly 53 is also provided with positioning holes penetrating it, specifically, the first main magnet 531, the magnetizer 533 and the second main magnet 535 are respectively provided with first positioning holes 5311, magnetizer positioning holes 5331 and second positioning holes 5351 penetrating them and communicated with one another to form the positioning holes.

The center points of the first positioning holes 5311, the magnetizer positioning holes 5331 and the second positioning holes 5351 and the center points of the cylinders 5913 are on the same straight line, that is, the first positioning holes 5311, the magnetizer positioning holes 5331 and the second positioning holes 5351 just coincide and correspond to the fasteners 591, and the cylinders 5913 can penetrate through the positioning holes, so that the fixing effect of the fasteners 591 on the main magnet assembly 53 is better, and the reliability of the magnetic circuit system 5 is effectively guaranteed.

The pressure plate 593 includes through holes 5931 penetrating it. The pressure plate 593 is of a flat-plate structure, penetrates through the accommodating hole 311 of the diaphragm 31 and presses against the first main magnet 531. The inner circumference 312 of the diaphragm 31 is fixedly connected with the surface of the first main magnet 531 departing from the yoke 51, and is on the same horizontal plane as the surface of the pressure plate 593 close to the yoke 51. The surface of the pressure plate 593 close to the yoke 51 presses against the surface of the first main magnet 531 departing from the yoke 51 to fix the main magnet assembly 53, so that the main magnet assembly 53 is compacted and fixed.

The center points of the through holes 5931 and the first positioning holes 5311 are on the same straight line, that is, the through holes 5931 and the first positioning holes 5311 just coincide.

The cylinders 5913 of the fasteners 591 sequentially penetrate through the second positioning holes 5351, the magnetizer positioning holes 5331, the first positioning holes 5311 and the through holes 5931 to fix the second main magnet 535, the magnetizer 533, the first main magnet 531 and the pressure plate 593, and the pressure plate 593 presses the first main magnet 531 tightly, thereby fixing the main magnet assembly 53, effectively preventing the main magnet assembly 53 from dropping or failing due to the repulsive force, and guaranteeing the reliability of the magnetic circuit system 5.

The bases 5911 of the fasteners 591 and the yoke 51, the cylinders 5913 of the fasteners 591 and the pressure plate 593, can be fixed by welding with high fastness, or connected via threads or in other mode, so that the reliability of the magnetic circuit system 5 can be further improved.

The pressure plate 593 can fix the main magnet assembly 53 in the horizontal direction; the fasteners 591 penetrate through the second main magnet 535, the magnetizer 533, the first main magnet 531 and the pressure plate 593 in sequence, and can simultaneously fix the main magnet assembly 53 in the vertical direction, so the fixing assembly 59 can simultaneously fix the repulsive first main magnet 531 and second main magnet 535 in the horizontal direction and the vertical direction more firmly, and the fixing assembly 59 with appropriate size can be designed with more flexibility according to the structure and the shape of the main magnet assembly 53.

Compared with the prior art, the speaker provided by the present disclosure has the advantages that the magnetic circuit system is additionally provided with the fixing assembly for fixing the homopolarly opposite first main magnet and second main magnet, and the fixing assembly includes fasteners and a pressure plate matched with the fasteners and can simultaneously fix the main magnet assembly in the horizontal direction and the vertical direction, thereby effectively preventing the main magnet assembly from dropping or failing due to the repulsive force, guaranteeing the reliability of the magnetic circuit system and then guaranteeing the acoustic performance of the speaker; the fasteners penetrate through the internal space of the main magnet assembly without occupying the space of the magnetic gap, thereby reducing the influence on other assemblies; and the yoke of the magnetic circuit system is provided with yielding gaps for accommodating the bases of the fasteners, thereby reducing spatial loss as much as possible and preventing shifting.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a shell;

a vibration system, received in the shell; and a magnetic circuit system, disposed below the vibration system and used for driving the vibration system to vibrate for producing sound, the magnetic circuit system comprising a main magnet assembly, a fixing assembly and a yoke for assembling the main magnet assembly;

wherein the main magnet assembly comprises a first main magnet, a second main magnet homopolarly opposite to the first main magnet and spaced from the first main magnet, a magnetizer sandwiched between the first main magnet and the second main magnet, and positioning holes penetrating the first main magnet, the magnetizer and the second main magnet;

the fixing assembly comprises fasteners penetrating through the positioning holes and a pressure plate matched with the fasteners to fix the main magnet assembly, the fastener comprises a base disposed on the yoke and a cylinder extended from the base to a direction departing from the yoke, the main magnet assembly sandwiched between the yoke and the pressure plate, the pressure plate comprises through holes penetrating it, and the cylinders penetrate through the positioning holes and the through holes in sequence.

2. The speaker as described in claim 1, wherein the yoke is provided with yielding gaps for accommodating the bases.

3. The speaker as described in claim 1, wherein the fasteners, the pressure plate and the yoke are in threaded connection.

4. The speaker as described in claim 1, wherein the fasteners, the pressure plate and the yoke are fixed by welding.

5. The speaker as described in claim 1, wherein the vibration system comprises a diaphragm, an accommodating hole is formed in the center of the diaphragm, and the pressure plate penetrates through the accommodating hole and presses against the first main magnet.

6. The speaker as described in claim 5, wherein the diaphragm comprises an inner circumference surrounding the accommodating hole, an outer circumference fixedly connected with the shell and a vibration part connecting the inner circumference with the outer circumference.

7. The speaker as described in claim 6, wherein the shell comprises a cover plate and a frame assembled with the cover plate to form a receiving space, and the outer circumference of the diaphragm is sandwiched between the cover plate and the frame.

8. The speaker as described in claim 7, wherein the inner circumference of the diaphragm is fixedly connected with the first main magnet.

9. The speaker as described in claim 1, wherein there are two fasteners, and the two fasteners are spaced from each other and disposed symmetrically.

10. The speaker as described in claim 1, wherein the positioning holes, the through holes and the fasteners are disposed in one-to-one correspondence.

* * * * *